US005685033A

United States Patent [19]

Lavin

[11] Patent Number: 5,685,033

[45] Date of Patent: Nov. 11, 1997

[54] LAVIN LIFT STRAP

[76] Inventor: Manuel S. Lavin, Lavin Inc. P.O. Box 91, Belleville, Mich. 48111

[21] Appl. No.: 595,195

[22] Filed: Feb. 1, 1996

[51] Int. Cl.[6] ..... A61G 7/10

[52] U.S. Cl. ..... 5/89.1; 5/81.1 R

[58] Field of Search ..... 5/81.1 R, 81.1 HS, 5/81.1 T, 89.1, 83.1, 86.1, 87.1

[56] References Cited

U.S. PATENT DOCUMENTS

| | | | |
|---|---|---|---|
| 2,323,500 | 7/1943 | Trigg | 5/81.1 T |
| 2,523,891 | 9/1950 | Wallstrom | 5/89.1 X |
| 3,458,878 | 8/1969 | Combs | 5/81.1 T |
| 3,859,677 | 1/1975 | Nordwig | 5/89.1 |
| 4,221,011 | 9/1980 | Flinchbaugh | 5/89.1 |
| 4,536,903 | 8/1985 | Parker | 5/81.1 T |
| 5,579,546 | 12/1996 | Griskauskas | 5/81.1 T |

FOREIGN PATENT DOCUMENTS

| | | | |
|---|---|---|---|
| 2213734 | 8/1989 | United Kingdom | 5/89.1 |

*Primary Examiner*—Michael F. Trettel
*Attorney, Agent, or Firm*—Foley & Lardner

[57] ABSTRACT

A invention is directed to a method and apparatus for lifing a bedridden person from a bed. The method involves securing a strap to each leg of the person while the person is lying down in a bed; securing each strap to a lift bar of a lifting device; raising the lift bar of the lifting device so as to raise only the lower portion of the person from the bed, thereby permitting a caregiver to clean or change the person. The apparatus includes a lift strap for attachment to a leg of a person. The lift strap has a main support member adapted for positioning above a patient's knee; a wire eye member secured to the main support member and projecting away from the support member; and a fastening member secured to the main support member, for securing the main support member to the patient. The fastening member includes a first strap member secured to one end of the main support member and a buckle member fixed to an opposite end of the main support member.

4 Claims, 1 Drawing Sheet

LAVIN LIFT STRAP

FIELD OF THE INVENTION

The invention is directed to a lift strap which may be utilized to lift a portion of a patient's body. The invention has application in hospitals, nursing homes, private homes, or any other environment which has bedridden persons requiring third party care as for example, elderly or paraplegic patients.

SUMMARY OF THE INVENTION

The invention may be characterized as a method for lifting a bedridden person by securing a strap to each leg of the person while the person is lying down in the bed; securing each strap to a lift bar of a lifting device; raising the lift bar of the lifting device so as to raise only the lower portion of the person from the bed thereby permitting a caretaker to clean or change the patient.

The invention may also be characterized as a lift strap for attachment to a leg of a patient desired to be lifted from a bed wherein the lift strap a securing device. The main support member is adapted for positioning above the patient's knee. The "wire eye" member is secured to the main support member and projects away from the support member. The securing device is adapted to secure the main support member to the patient's leg and includes a first strap member secured to one end of the main support member and a buckle member fixed to an opposite end of the main support member.

DETAILED DESCRIPTION OF THE PREFERRED EMBODIMENTS

Figure 1:
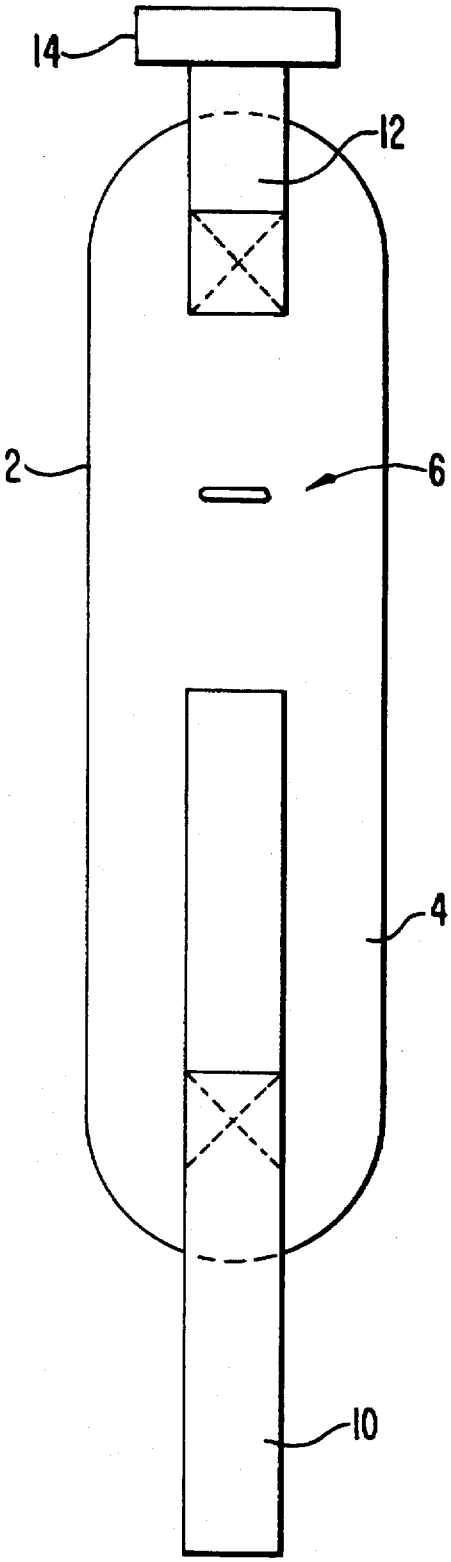
FIG. 1 shows a plan view of the lift strap.
Figure 2:
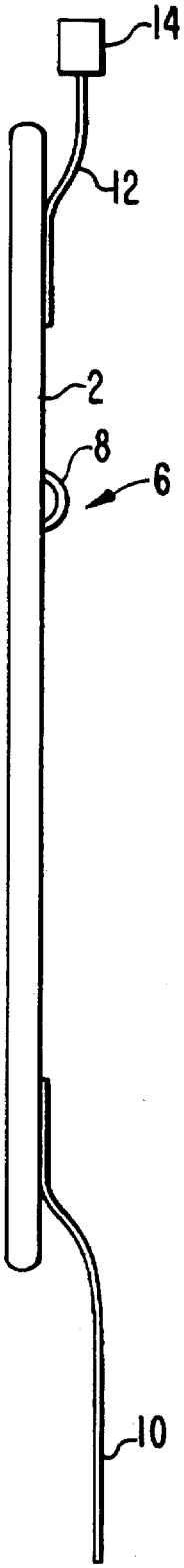
FIG. 2 shows a side view of the lift strap.

In reference to FIGS. 1 and 2, a strap 2 is illustrated having a cover member 4 which forms a main support member for the strap. A wire form 6 is secured to the cover member 4 and has an eye member 8 as shown in FIG. 2. A first strap member 10 is attached to one end of the cover member 4 and a second strap member 12 is attached to an opposite end of the cover member 4. A buckle 14 is secured to the strap 12. The first strap member 10 may be fabricated from hook and loop fastener material sold under the trademark Velcro.

The wire form 6 may be made from one-quarter inch diameter stainless steel and is secured to the cover member 4 to expose the eye member 8. The cover member 4 may be fabricated from 430 Denier nylon pack cloth with one-quarter inch foam and a nylon backing. The foam core may comprise a 10 millimeter closed cell foam. Further, the buckle 14 may be made of one and one-quarter inch plastic.

The lift strap has been tested and has a tensile strength of 429.9 lbs. for a single strap. Since the strap is used as a pair, and is intended for lifting only the lower portion of a patient, the above mentioned tensile strength is quite sufficient to handle a patient of any size.

An operation, a pair of straps such as the one illustrated in FIGS. 1 and 2 are utilized to lift only the lower portion of a patient's body. The pair of straps are to be utilized as an accessory to homecare lifters such as the Hoyer homecare lifter as an example. Each strap is placed on the patient's leg above the knee while the patient is lying down in bed. The lifting device (for example, the Hoyer lifter) is then placed above the patient's knees and the patient is then attached to the lift swivel bar of the lifting device by using an S hook or a closed hook generally provided on the lifter that will attach to the eye member 8 of the wire form 6. After a strap has been so placed on each leg of the patient, and thereby attached to the lifting device, the patient can be lifted in a comfortable manner high enough for the caretaker to clean or change the patient.

The main purpose of the lift straps is to lift the lower portion of the patient's body thereby allowing the caregiver the ability to clean the patient or change soiled clothing or bed linens. The caregiver will be able to do this without having to lift the patient, turn the patient over or require the assistance of another person in performing these tasks.

I claim:

1. A method of lifting a bedridden person comprising the steps of:

a) securing a strap to each leg of said person while said person is lying down in a bed;

b) securing each strap to a lift bar of a lifting device; and c) raising said lift bar of said lifting device so as to raise only the lower portion of said person from said bed, thereby permitting a caregiver to clean or change said person.

2. A method for lifting a bedridden person as recited in claim 1 wherein said step b) includes the step of securing each strap at a portion above the knee of said person.

3. A lift strap for attachment to a leg of a person desired to be lifted from a bed, said lift strap comprising:

a) a main support member, said main support member adapted for positioning above said person's knee;

b) a wire eye member secured to said main support member, said eye member projecting away from said support member; and c) means, secured to said main support member, for securing said main support member to said person, said means comprising:

i) a first strap member secured to one end of said main support member; and ii) a buckle member fixed to an opposite end of said main support member.

4. A lift strap as recited in claim 3 wherein said first strap is fabricated from a self securing material such as hook and loop fastener material.

* * * * *